US008986172B2

(12) United States Patent
Poole

(10) Patent No.: US 8,986,172 B2
(45) Date of Patent: Mar. 24, 2015

(54) EXERCISE SLED

(75) Inventor: Tyrone Poole, Atlanta, GA (US)

(73) Assignee: The Bachar Corporation, Marietta, GA (US)

( * ) Notice: Subject to any disclaimer, the term of this patent is extended or adjusted under 35 U.S.C. 154(b) by 347 days.

(21) Appl. No.: 13/572,520

(22) Filed: Aug. 10, 2012

(65) Prior Publication Data

US 2013/0172160 A1 Jul. 4, 2013

Related U.S. Application Data

(60) Provisional application No. 61/523,095, filed on Aug. 12, 2011.

(51) Int. Cl.

| | |
|---|---|
| ***A63B 21/04*** | (2006.01) |
| ***A63B 21/055*** | (2006.01) |
| ***A63B 21/072*** | (2006.01) |
| ***A63B 23/035*** | (2006.01) |
| ***A63B 23/04*** | (2006.01) |
| *A63B 69/00* | (2006.01) |
| *A63B 5/00* | (2006.01) |
| *A63B 21/00* | (2006.01) |

(52) U.S. Cl.

CPC ..... *A63B 21/0442* (2013.01); *A63B 69/0028* (2013.01); *A63B 5/00* (2013.01); *A63B 21/0552* (2013.01); *A63B 21/0557* (2013.01); *A63B 21/072* (2013.01); *A63B 21/1469* (2013.01); *A63B 21/1473* (2013.01); *A63B 21/1484* (2013.01); *A63B 23/03525* (2013.01); *A63B 23/03541* (2013.01); *A63B 23/0355* (2013.01); *A63B 23/0458* (2013.01); *A63B 23/047* (2013.01)

USPC ..... 482/93; 482/129; 473/441; D21/788

(58) Field of Classification Search

CPC ..... A63B 21/1469; A63B 2208/0204; A63B 21/068; A63B 23/047; A63B 21/0618; A63B 69/345; A63B 2243/007; A63B 2022/0079; A63B 5/16

USPC ..... 482/90, 93, 94, 95, 114, 129, 148, 482/51–52; 473/438, 440, 441, 445, 447; 280/20, 43.24, 79.3; D21/534, 698, D21/767, 788, 791

See application file for complete search history.

(56) References Cited

U.S. PATENT DOCUMENTS

| | | | | | |
|---|---|---|---|---|---|
| 715,405 | A | * | 12/1902 | Mauser | 280/20 |
| 831,513 | A | * | 9/1906 | Johnson | 280/20 |
| 1,040,193 | A | * | 10/1912 | Hammond | 280/20 |
| 1,300,095 | A | * | 4/1919 | Aldrich | 280/20 |
| 2,237,600 | A | * | 4/1941 | Gilman | 473/445 |
| 2,314,293 | A | * | 3/1943 | Tyndall | 280/14.1 |
| 2,473,076 | A | * | 6/1949 | Scheibner | 280/19.1 |
| 3,003,778 | A | * | 10/1961 | Taggart | 280/28.14 |

(Continued)

*Primary Examiner* — Stephen Crow
*Assistant Examiner* — Andrew S Lo
(74) *Attorney, Agent, or Firm* — Staniford Tomita LLP

(57) ABSTRACT

Embodiments are described for an exercise sled including an upper portion detachably coupled to a lower portion through telescoping leg assemblies located at the corners of the sled. The upper portion includes a flat jumping surface to facilitate jumping or step-up type exercises, and the lower portion includes a sled rail portion to facilitate sliding across a surface, and a weight platform for the addition of plate weights. A number of attachment hooks facilitate the use of cords or handles to perform resistance exercises using the sled as an exercise platform.

16 Claims, 8 Drawing Sheets

(56) References Cited

U.S. PATENT DOCUMENTS

| | | | | | |
|---|---|---|---|---|---|
| 3,061,326 | A | * | 10/1962 | Rasmussen | 280/20 |
| 3,201,120 | A | * | 8/1965 | Moravetz | 482/26 |
| 3,319,971 | A | * | 5/1967 | Thomas et al. | 280/16 |
| 3,634,895 | A | * | 1/1972 | Childers | 5/420 |
| 3,744,811 | A | * | 7/1973 | Johnston | 280/28.14 |
| 4,037,834 | A | * | 7/1977 | Oaks | 482/27 |
| 4,219,207 | A | * | 8/1980 | Muir et al. | 280/22.1 |
| 4,254,964 | A | * | 3/1981 | Gibson | 280/20 |
| 4,302,023 | A | * | 11/1981 | Kiesz | 280/43.24 |
| 4,802,670 | A | * | 2/1989 | Smith | 473/445 |
| 5,213,554 | A | * | 5/1993 | Goldstein et al. | 482/52 |
| 5,275,579 | A | * | 1/1994 | Wilkinson | 482/52 |
| 5,385,523 | A | * | 1/1995 | Forrest | 473/445 |
| 5,433,458 | A | * | 7/1995 | Kampe | 280/14.28 |
| 5,853,352 | A | * | 12/1998 | Login | 482/26 |
| 6,257,599 | B1 | * | 7/2001 | Johnson et al. | 280/8 |
| D478,954 | S | * | 8/2003 | Forrest | D21/788 |
| 6,988,965 | B2 | * | 1/2006 | Krause | 473/445 |
| D562,417 | S | * | 2/2008 | Noojin | D21/698 |
| 7,416,412 | B2 | * | 8/2008 | Segrest et al. | 434/226 |
| D606,611 | S | * | 12/2009 | Rogers et al. | D21/788 |
| 7,727,089 | B2 | * | 6/2010 | Gilman | 473/445 |
| 2005/0218629 | A1 | * | 10/2005 | Stacy | 280/639 |
| 2006/0040796 | A1 | * | 2/2006 | Holloway | 482/52 |
| 2006/0052220 | A1 | * | 3/2006 | Jackson et al. | 482/52 |
| 2010/0203986 | A1 | * | 8/2010 | Gilman | 473/445 |
| 2011/0177891 | A1 | * | 7/2011 | Gilman | 473/441 |
| 2011/0224051 | A1 | * | 9/2011 | Larish | 482/93 |
| 2012/0091671 | A1 | * | 4/2012 | Soloviev | 280/20 |
| 2012/0172155 | A1 | * | 7/2012 | Gilman | 473/447 |

* cited by examiner

EXERCISE SLED

CROSS-REFERENCE TO RELATED APPLICATIONS

This application claims priority from U.S. Provisional Patent Application No. 61/523,095, filed on Aug. 12, 2011, and entitled "Exercise Sled".

FIELD OF THE INVENTION

One or more implementations relate generally to exercise equipment, and more specifically to a modular sled and weight platform for exercise and sports training.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Exercise equipment for home and professional use is a growing industry with many competing products. To cover all of the various exercises that may be performed often requires the use of many different items of equipment, such as free weights, weight machines, treadmills, stairclimbers, and so on. As evidenced by the many fitness centers that are becoming ever more popular, such equipment is typically very expensive, heavy, and takes up a lot of space. Professional training equipment for sports such as football are likewise very large and expensive systems that are designed for specific exercises.

Multi-use equipment has been developed to allow people to use the same piece of equipment to perform different exercises. Such equipment is usually designed for indoor use and can be complicated and difficult to use in that weight and seating positions must often be changed or reconfigured to accommodate different exercises. This equipment is also often quite large and expensive, and not portable enough to facilitate field use in different environments. Present exercise devices also generally do not lend themselves to use for different types of exercises or training regimens. For example, weight training exercises often require the use of individual free weights or resistance machines, while running exercises or plyometric type exercises often require the use of other specialized equipment. This can increase the cost and complexity of equipment needed to perform a wide range of common exercises.

What is needed therefore is an exercise apparatus that is modular and portable to facilitate ease of use across a wide range of different exercises.

BRIEF SUMMARY

Embodiments are generally directed to an exercise or training sled that combines a jumping box and a pulling sled that is adjustable with regard to size and weight capacity. The exercise sled comprises a lower section of substantially rectangular shape having four legs at each corner of the rectangle and a pair of curved rails for sliding across a surface, an upper portion detachably coupled to the lower section through matching leg sections and including a flat surface; and a plurality of attachment hooks disposed around at least one of the lower section and upper portion for facilitating pulling or pushing the sled across the surface. The lower section includes a weight platform including a post structure to hold a weight plate. The upper portion of the weight platforms includes a flat, non-slip surface to allow use as a step-up or jump-up platform. Users can perform a variety of exercises by pulling the sled along a surface and using the platform on the upper surface to perform step ups and similar routines.

The training sled features a size, shape, and configuration that allows a user to quickly switch from speed drills to weight training without requiring the use of different equipment. The training sled accommodates the attachment of straps and pulleys at different locations so that it can be used by a number of different people at any one time.

Any of the embodiments described herein may be used alone or together with one another in any combination. The one or more implementations encompassed within this specification may also include embodiments that are only partially mentioned or alluded to or are not mentioned or alluded to at all in this brief summary or in the abstract. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Embodiments are directed to an item of exercise equipment referred to as an "exercise sled" or "training sled" that combines a jumping box (an object with four legs that can be climbed or stepped onto and jumped on) and a pulling sled (an object that can be attached to a person via cords and towed while running or walking). The training sled is square or rectangular shaped and is adjustable on all four sides with respect to the height of the unit. An upper portion of the sled incorporates the jumping box, and a lower portion incorporates the pulling sled. The upper portion of the sled fits into the lower portion of the sled through four legs attached to the four corners of each of the top and lower portions and held in place by pins. The legs of the upper portion are designed to slide into the legs of the lower portion. The sled is height adjustable on all four corners by disconnecting the placement pins and raising or lowering the upper portion relative to the lower portion. Depending on the overall dimensions of the sled, the height can be adjusted from between 6 inches to 20 inches (6" to 20") in an embodiment.

The sled can be used with a variety of different exercise regimens to increase running speed, running power, and upper and lower body strength. Running speed and power is increased by pulling or towing the sled or by doing plyometric drills using the sled. Upper body strength is increased by performing exercises with bands/cords or other attachments that attach to fixed hooks or attachment points positioned at different points around the sled. The hooks can be positioned around the front, back and sides of the sled.

The sled includes a center section within the lower portion that includes a free weight mounting platform. Such a platform can include a pole or pipe section that can accommodate a standard weight plate. In an embodiment, the platform can support one or more plates from 2.5 lbs to 45 lbs for mounting a practical maximum amount (e.g., 135 lbs) of added weight.

In an embodiment, the sled is made of a metal frame for both the upper and lower portions. The jumping platform on the upper portion can be made of rubber or wood, or any similar material. The lower portion incorporates a curved rail or frame section that allows the sled to slide across a surface. Virtually any surface, wet or dry and indoor or outdoor, can be used to deploy the sled. For pulling and towing exercises, grass, sand, wood or soil surfaces are generally preferable, but other surfaces, such as concrete, asphalt, etc., can also be used.

The exercise sled represents a total, nonstop piece of training equipment in which a person can go from speed to weight training without needing to use different pieces of equipment or traveling to a different facility. The sled can also be used by multiple people at once, and can be used cooperatively so that their individual efforts can add or subtract from each other.

Figure 1:
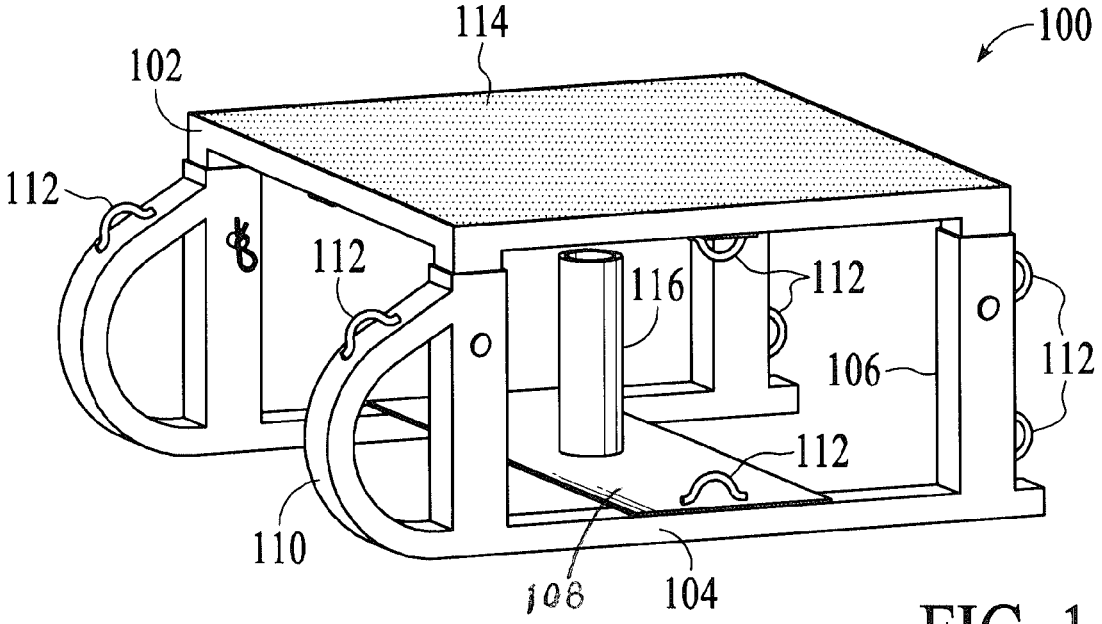
FIG. 1 is a first perspective view of an exercise sled, according to an embodiment.

FIG. 1 is a first view of an exercise sled, according to an embodiment. As shown in FIG. 1, exercise sled 100 is a substantially rectangular structure that includes an upper portion 102 detachably coupled to a lower portion 104 through four legs 106 positioned at each corner. The upper and lower portions are height adjustable with respect to each other through sliding the top legs up and down in the lower legs and fixing their position through a pin and hole assembly.

The upper portion 102 includes a flat jumping surface 114 that is made of rubber, cork, wood, metal or any similar surface that allows a person to stand or jump comfortably on the top surface of the sled. The jumping surface 114 is preferably made of a non-slip material or treated with a non-slip treatment to allow a user to step or jump onto the surface without slipping. The size and shape of the jumping surface 114 can be configured to facilitate exercises such as running-in-place, squats, jumps, and so on.

The lower portion 104 includes a curved section 110 at one or both ends. This curved portion allows the sled to be dragged along a surface, and provides the "sled" aspect to the unit. The lower portion 104 also includes a weight platform 108 with a pole or pipe section 116 that can hold one or more standard weight plates.

The exercise sled 100 includes a number of hooks or rings 112 placed in various points around the sled to serve as attachment points for cords, ropes, straps, belts, handles and other accessories that allow a user to pull or push against the sled. Optionally, grab handles or surfaces can be incorporated directly on the sled to allow pulling or pushing directly against the sled. In a typical application, one or more straps are attached to appropriate locations of the exercise sled so that a user can pull or drag the sled along the ground. Optional weight plates can be loaded onto the weight platform 108 to increase the overall weight of the sled. Alternatively, the sled can be pushed along the ground to perform pushing exercises. For example, appropriately shaped tackle or blocking pads can be attached to the hooks to allow a user to push the sled with his upper or lower body.

Figure 2A:
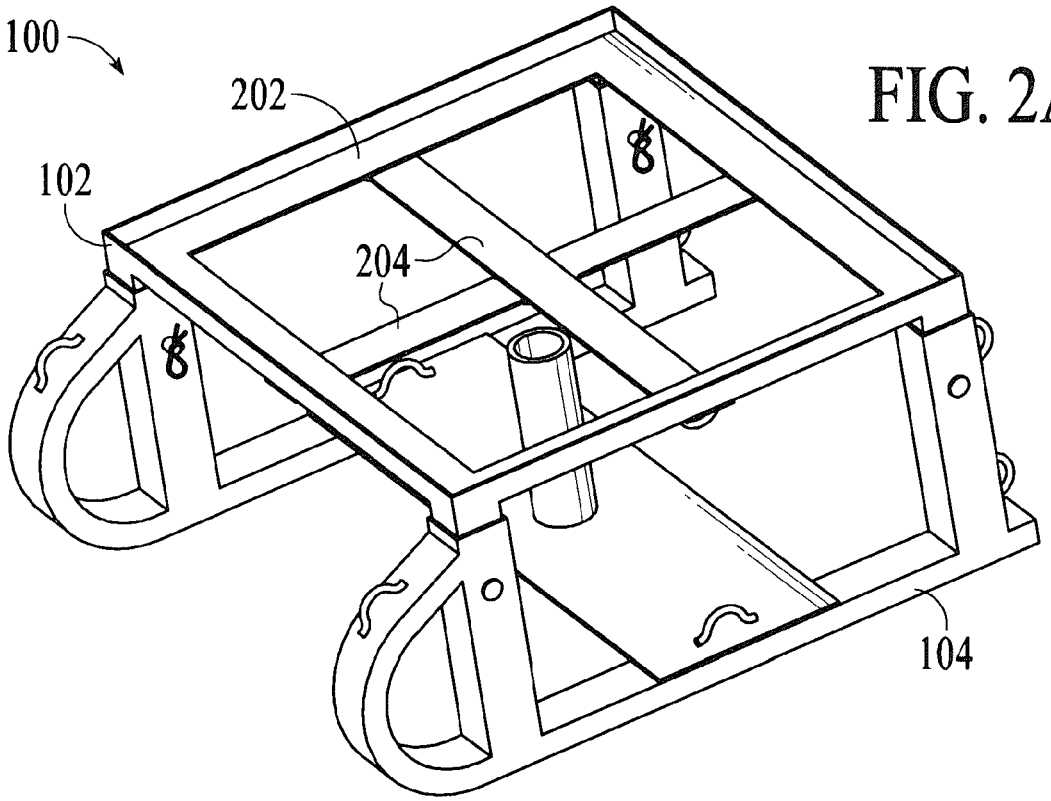
FIG. 2A illustrates an exercise sled comprising an upper and lower portion without an attached jumping surface, under an embodiment.
Figure 2B:
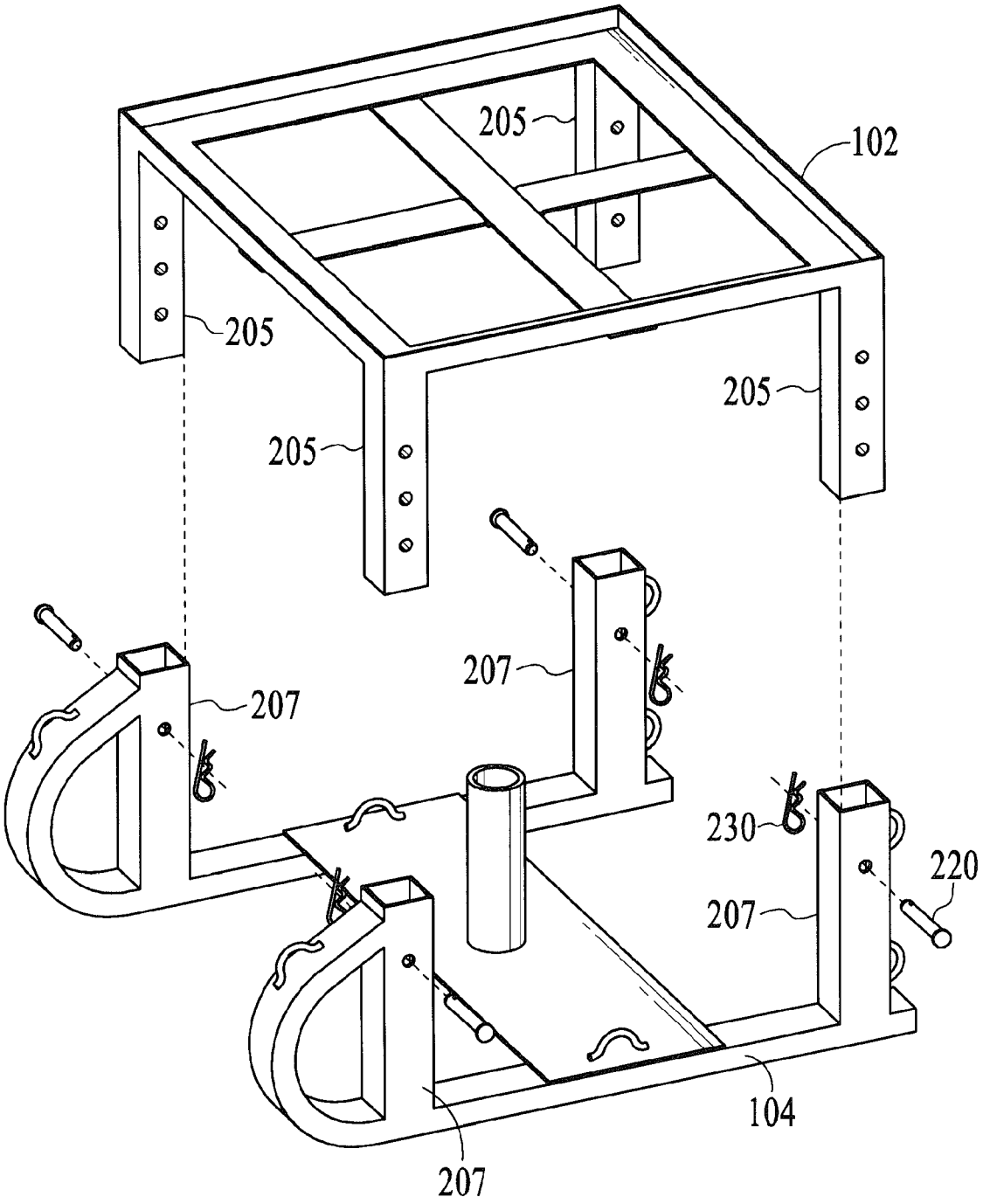
FIG. 2B illustrates the upper portion of the exercise sled separated from the lower section, under an embodiment.

FIG. 1 illustrates the exercise sled in a fully configured implementation state, under an embodiment. The exercise sled may be manufactured as separate components, such as the lower portion 104, upper portion 102, and the jumping surface 114. FIG. 2A illustrates the exercise sled of FIG. 1 comprising an upper and lower portion without an attached jumping surface, under an embodiment. As shown in FIG. 2A, the upper portion 102 comprises a square or rectangular section with support posts at each corner. FIG. 2B illustrates the upper portion 102 separated from the lower section 104, and in a position where it is ready to be positioned onto the lower section through the four insertable posts 205. The upper portion support posts 205 are configured to be inserted into the corresponding posts 207 in the lower section 104 where they are held in position by one or more pins 220 or retaining elements in each post. This allows the upper portion 102 to slide or telescope up and down, and then be set to different heights relative to the lower portion 104. The retaining pins 220 may be straight pins that are simply inserted through the appropriate post holes, or they may be pins that are secured by cotter pins 230 or similar means. Other types of retaining pins may be used as well, such as bolts, dowels, and the like.

The upper portion 102 may include a support structure for placement or support of the non-slip jumping surface. Such a support structure may include an inner flange 202 portion along with one or more cross beams or cross members. 204. The configuration of the flange portion 202 and cross beams 204 may be configured appropriately depending on dimensions (e.g., thickness) and composition of the jumping surface material.

Figure 2C:
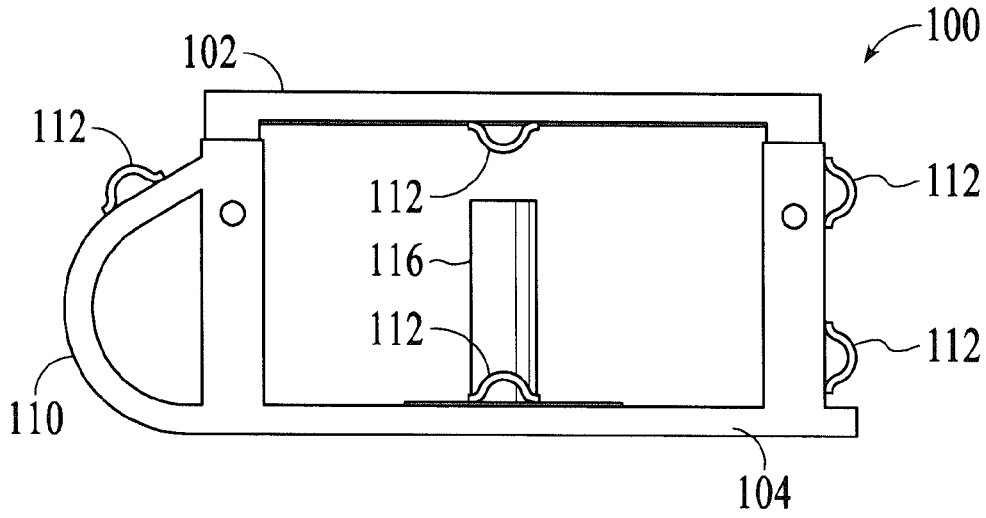
FIG. 2C is a side view of the exercise sled of FIG. 2A, under an embodiment.

FIG. 2C is a side view of the exercise sled on a surface, under an embodiment. The sled is configured to slide across virtually any surface, wet or dry and indoor or outdoor. As can be seen in FIG. 2C, the front section of the sled has the frame bars formed in a rounded shape to facilitate sliding of the sled along a surface. The shape and contour of the front portion 110 can be formed in any appropriate shape to facilitate sliding across particular surfaces. For indoor use, the typical surface may be carpet, mat, fiber, hardwood, or similar floor coverings, though other surfaces are also possible. For outdoor use, the typical surface may be grass, Astroturf, dirt, asphalt, sand or other surfaces. The bottom of the sled provides a sliding surface formed by the parallel frame rails attached to or formed as part of the front sled part of the unit.

Figure 2D:
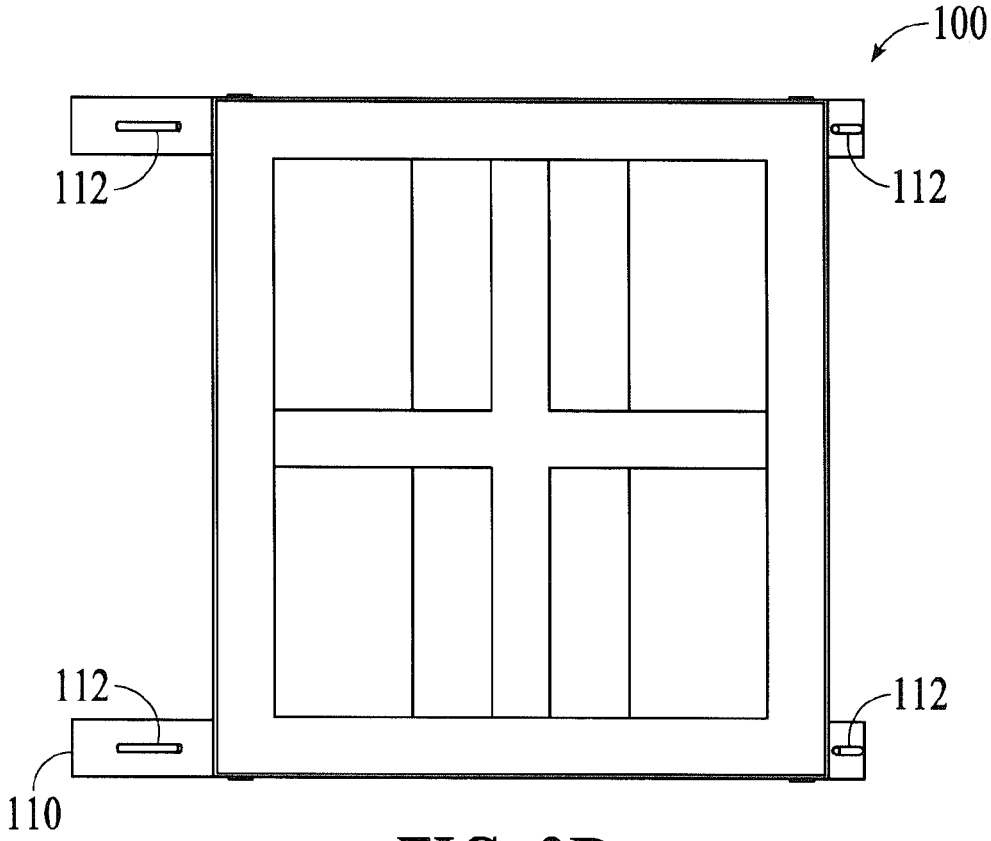
FIG. 2D is a top view of the exercise sled of FIG. 2A, under an embodiment.

FIG. 2D is a top view of the exercise sled, under an embodiment. This view illustrates how the front section 110 of the sled protrudes forward the jumping platform of the upper portion 102 of the sled, and how the placement of the hooks 112 allow attachment of cords or pulls that allow a user to pull the sled forward along the ground. Although the shape of sled 100 is square or nearly square when viewed from the top, it should be noted that the sled can be configured in various different rectangular or other shapes. The frame section of the top provides for the placement of a top surface that represents a main static exercise surface of the sled and is the place where people can stand jump or perform exercises such as step ups, squats, sit-ups, lunges, and so on. The top surface can comprise a mat made of rubber, plastic, fibers, or similar material that is attached to the sled by adhesives, or similar means. The overall dimensions of the sled can be of any practical size, depending on the environment and types of exercises to be performed. An example dimension of the jumping platform might be 3'×3' with a selectable height of 6" to 20" high, but other dimensions are possible.

Figure 2E:
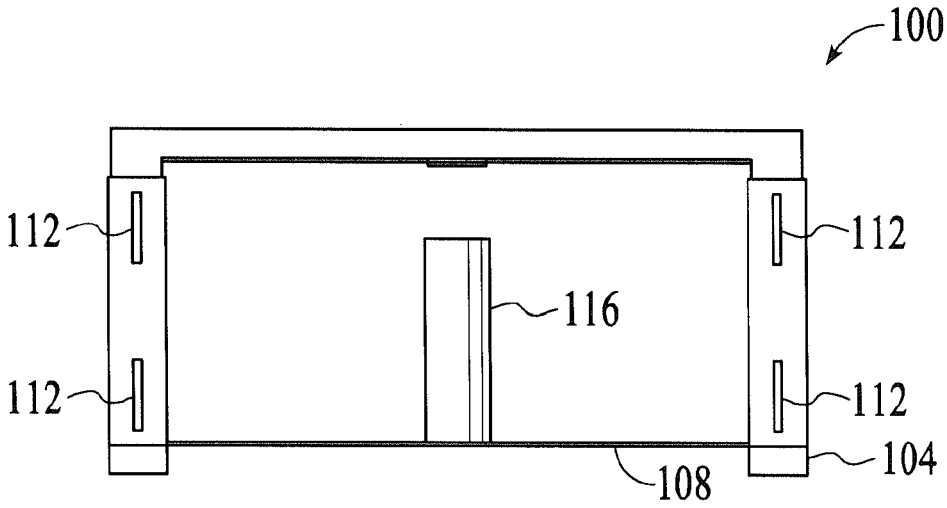
FIG. 2E is a back view of the exercise sled of FIG. 2A, under an embodiment.

FIG. 2E is a back view of the exercise sled of FIG. 3. This view shows the placement of the weight post 116 in a central location of the unit for the optimal placement of weights near the center of the unit. It also shows additional hook attachments 112 for the connection of straps or handles to allow the use of the sled as a weight-training tool.

Figure 3A:
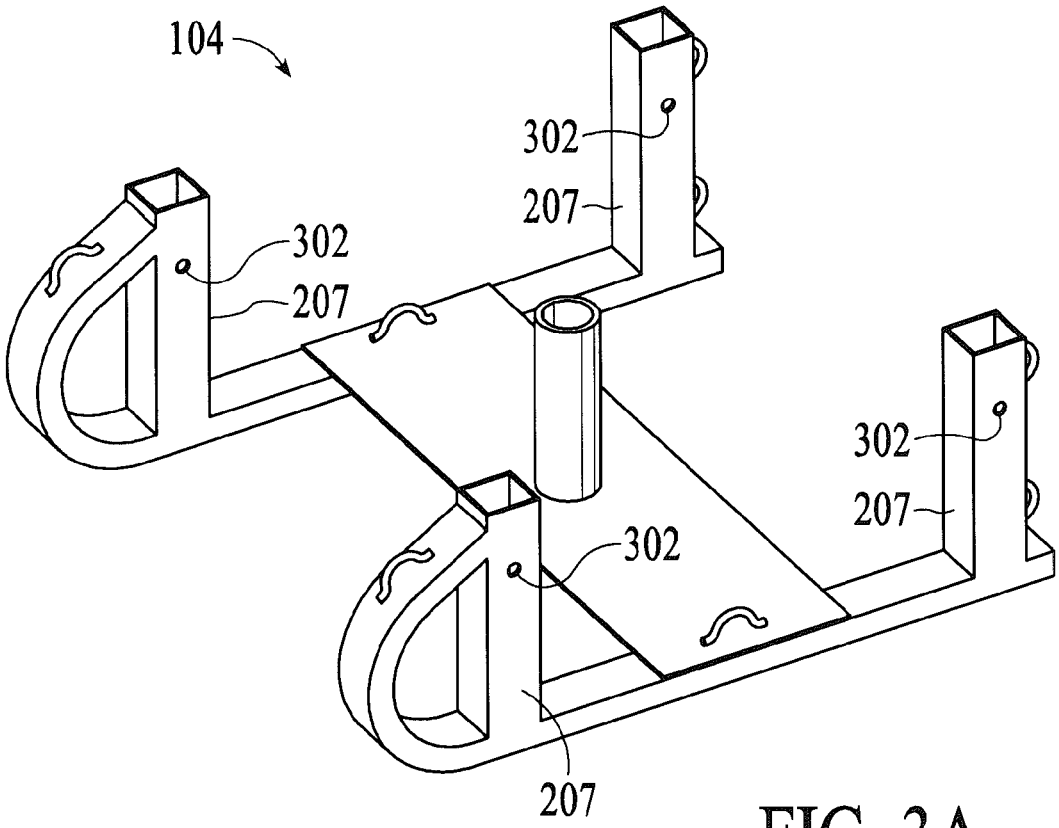
FIG. 3A illustrates a lower portion of an exercise sled with posts for attachment to an upper portion, under an embodiment.
Figure 3B:
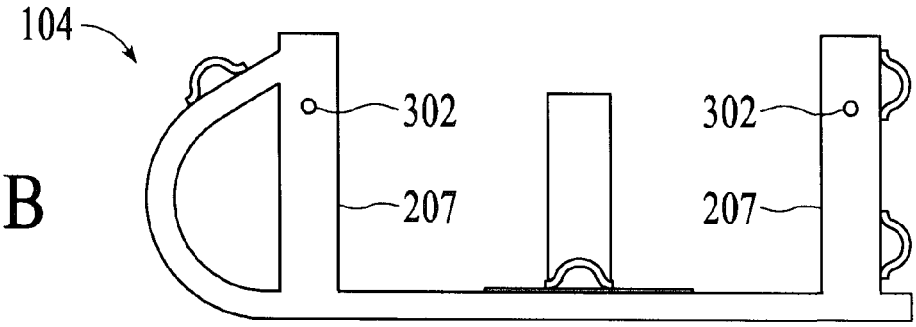
FIG. 3B is a side view of the lower portion of the exercise sled of FIG. 3A, under an embodiment.

FIG. 3A illustrates perspective view of a lower portion of an exercise sled with posts for attachment to an upper portion, under an embodiment. As shown in FIG. 3A, each of the four posts 207 of the lower portion 104 includes at least one hole 302 drilled therethrough. Each hole is configured to accommodate a pin or bolt that fits through a corresponding hole 402 in the inserted post of the upper portion. FIG. 3B is a side view of the lower portion of the exercise sled of FIG. 3A, under an embodiment. This view shows the position and placement of the insertion pin hole 302 in the each of the posts of the lower portion. The hole can be placed in any practical section of the post, but is typically placed to accommodate a range of up/down movement of the corresponding upper position posts relative to the lower portion posts. As shown in FIG. 3B, an example placement of the lower portion post holes is approximately one-quarter to one-third the distance down from the top of the post.

Figure 4A:
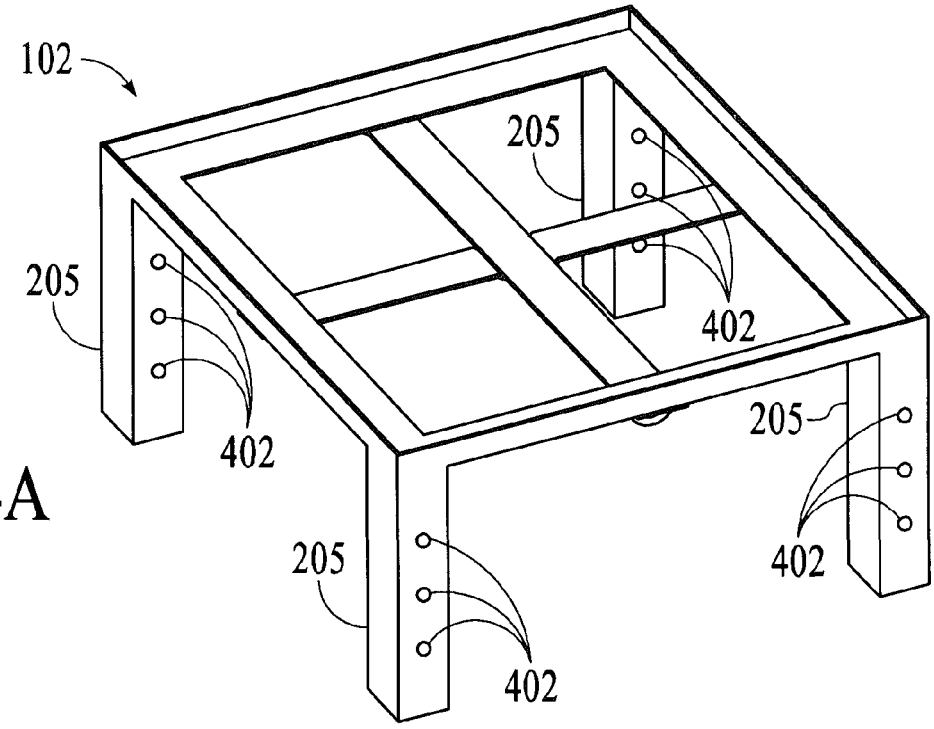
FIG. 4A illustrates perspective view of an upper portion of an exercise sled with posts for attachment to a lower portion, under an embodiment.
Figure 4B:
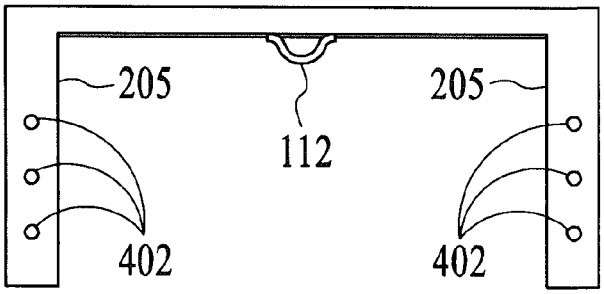
FIG. 4B is a side view of the upper portion of the exercise sled of FIG. 4A, under an embodiment.

FIG. 4A illustrates perspective view of an upper portion of an exercise sled with posts for attachment to a lower portion, under an embodiment. As shown in FIG. 4A, each of the four posts of the upper portion includes a plurality of holes 402 drilled therethrough. These holes are configured to accommodate a pin or bolt that fits through a corresponding hole in the receiving post of the lower portion. Any practical and appropriate number of holes 402 may be provided, and a typical number is two to four, and three holes per post are shown in FIG. 4A. Each hole 402 allows the upper portion to be set to a different height above the lower portion. In typical use, the top platform is flat relative to the lower portion so that the same hole per post should be used for attachment to the lower portion. In certain uses, it may be desired that the top surface be tilted relative to the lower portion. In this case, higher or lower holes in the individual posts of the upper portion may be used relative to the other posts for attachment to the lower portion. FIG. 4B is a side view of the lower portion of the exercise sled of FIG. 4A, under an embodiment. This view shows the position and placement of the insertion pin holes in the posts of the upper portion. The holes can be placed in any practical section of each post, but is typically placed to accommodate a range of up/down movement of the upper position posts relative to the lower portion posts. As shown in FIG. 4B, an example placement of the lower portion post holes is approximately each hole placed equidistant along the length of the post with some accommodation for a minimum amount of insertable post area left undrilled.

The embodiments of FIGS. 3A-3B and 4A-4B illustrate an example configuration in which multiple holes are provided in the posts of the upper portion relative to the posts of the lower portion to provide a range of different height placements. Alternatively, multiple holes can be provided in the posts of the lower portion and a single hole can be provided in the posts of the upper portion to provide the same flexibility in height placement. In a further alternative embodiment, multiple holes may be provided in both the upper and lower posts to provide a greater number of height adjustment options. In a typical embodiment, the upper portion is configured to be adjustable from 6" to 20" in height relative to the lower portion, but other height ranges are also possible. When set to a particular height, the upper and lower portions form a jumping box that allows a user to jump or step up and down to perform certain exercises.

Figure 5:
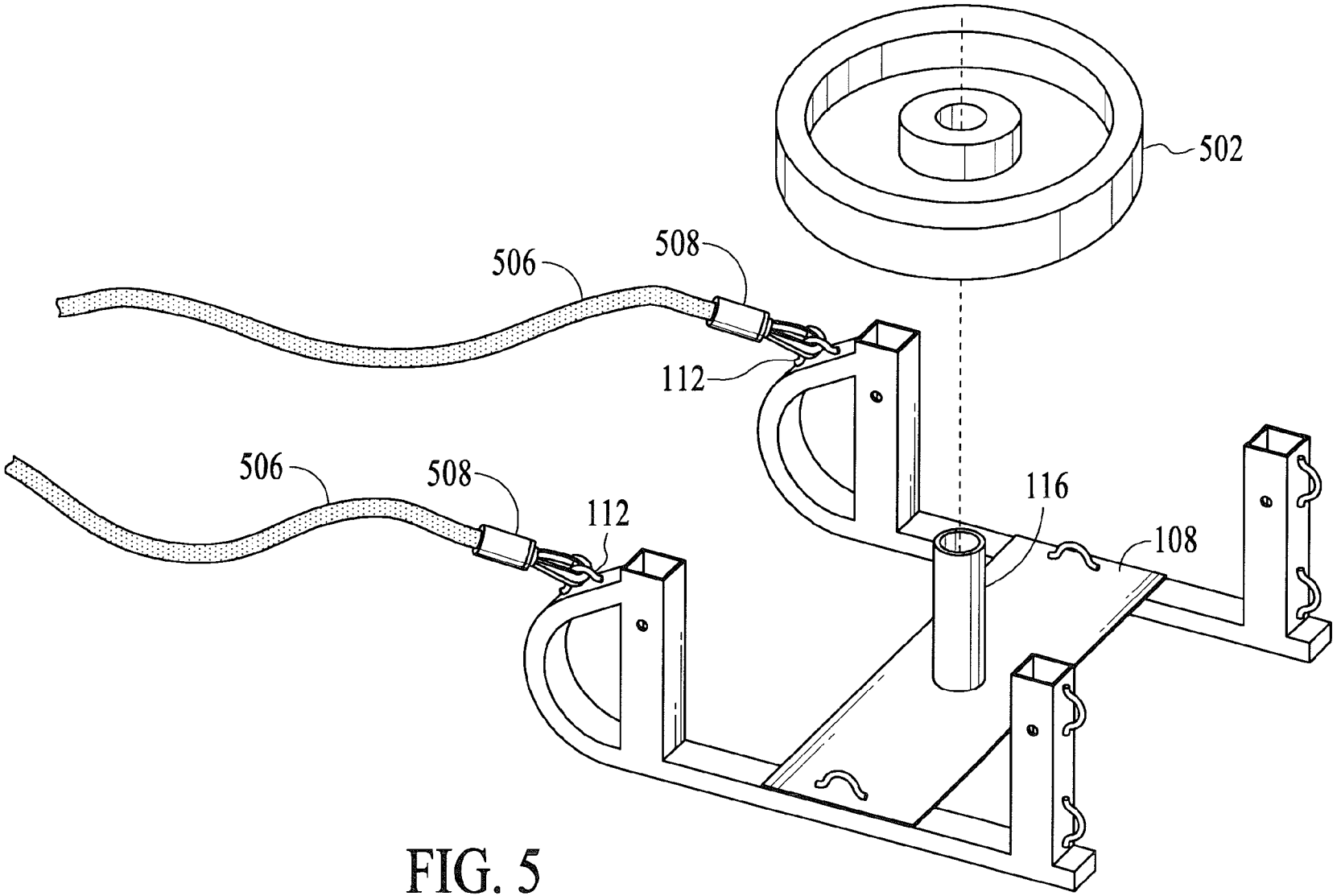
FIG. 5 illustrates a lower portion of an exercise sled with an optional weight plate, under an embodiment.

As shown in FIG. 1, the exercise sled 100 includes a pole or post 116 to accommodate the placement of standard weight plates. FIG. 5 illustrates a lower portion of an exercise sled with an optional weight plate 502, under an embodiment. As shown in FIG. 5, the lower portion includes the post, pole, or metal pipe section 116 that is designed to allow a standard plate-type weight 502 to be slid onto the bottom platform. A number of weight plates can be accommodated depending on the maximum load capacity of the sled (e.g., 135 lbs), and the height of the post (e.g., 8-10 inches). The size, shape, and length of the post 116 may be configured as needed to accommodate any appropriate type of weight. For the example shown, a standard gymnasium or Olympic weight plate is shown. The diameter of the post for these weights is either 1" or 2". Any type of free weight may be used however, and the post may be sized accordingly. Such weights may be made of steel, solid rubber, sand or water filled plastic, and the like. In typical usage, once placed, the weight plate should sit securely on the bottom of the platform 108 of the lower portion 104. In an embodiment, the post 116 is welded into place on the bottom of the platform. Alternatively, the post 116 may be bolted into place. This allows the post to be switched out to accommodate weight plates of different inner hole diameters.

As shown in FIG. 1, the exercise sled 100 includes a number of attachment hooks 112 or rings distributed in various locations around the sled. The example configuration of FIG. 1 shows hooks along the front sled portion, the back posts, and in the center of the sides of the upper and lower sections. Such attachment positions are illustrative, and many other positions and placements are possible depending on the types of exercises to be performed. The attachment hooks 112 are typically welded to the frame of the sled to provide a secure attachment area, and are formed in size and shape that allows for the tying or hooking of straps, belts, cords, handles, or other similar accessories.

FIG. 5 illustrates the lower portion 104 of the exercise sled with pulling cords 506 attached, under an embodiment. The cords may be tied to the attachment hooks or claims or hook rings 508 attached to the ends of the cords may be used. In an embodiment, the sled is used by pulling the sled (with or without weights) when walking, jogging, or running. The cords are used to wrap around ones arms, hands, legs, or body when pulling the sled. The cords attach to the attachment hooks or rings that are placed in appropriate locations of the sled. The exercise sled represents a heavy platform that provides resistance for certain exercises when using cord and/or handle accessories. If resistance cords are used, various exercises, such as pull-ups, bench presses, tricep extension, and so on, can be simulated. The cords can be attached to high points of the sled for arm exercises, or low points of the sled for leg exercises, or any combination thereof.

Figure 6:
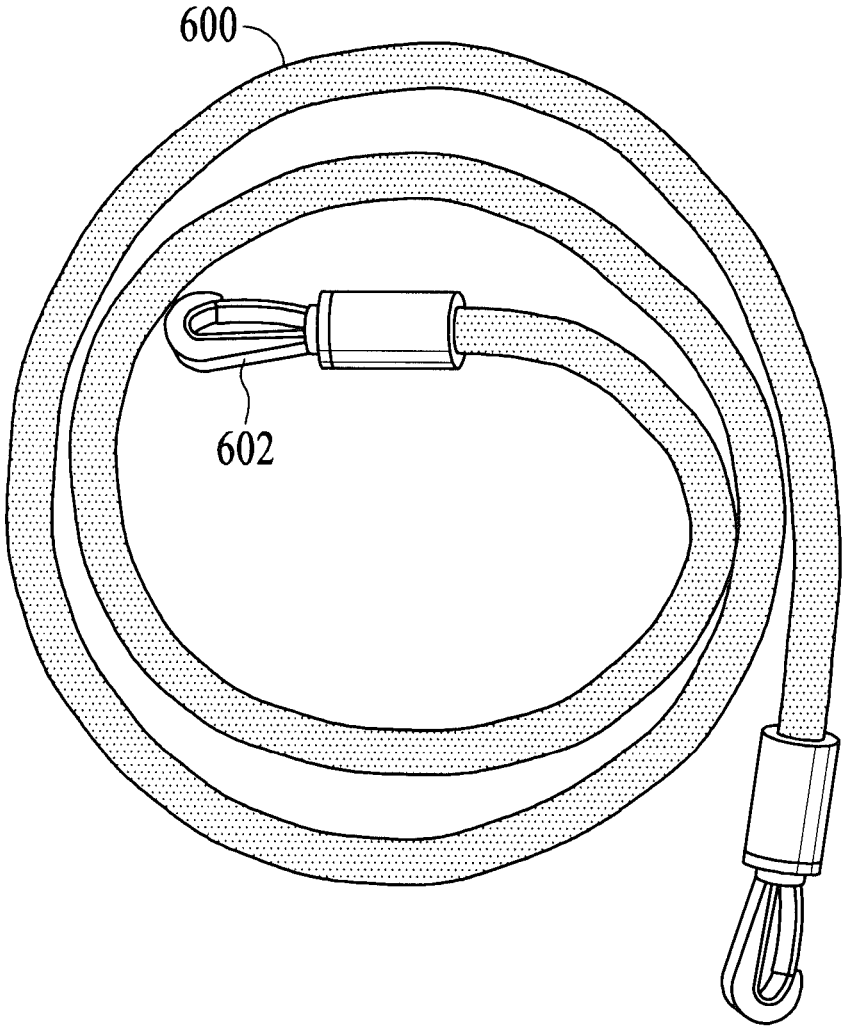
FIG. 6 illustrates a pulling cord that can be used in conjunction with an exercise sled, under an embodiment.
Figure 7:
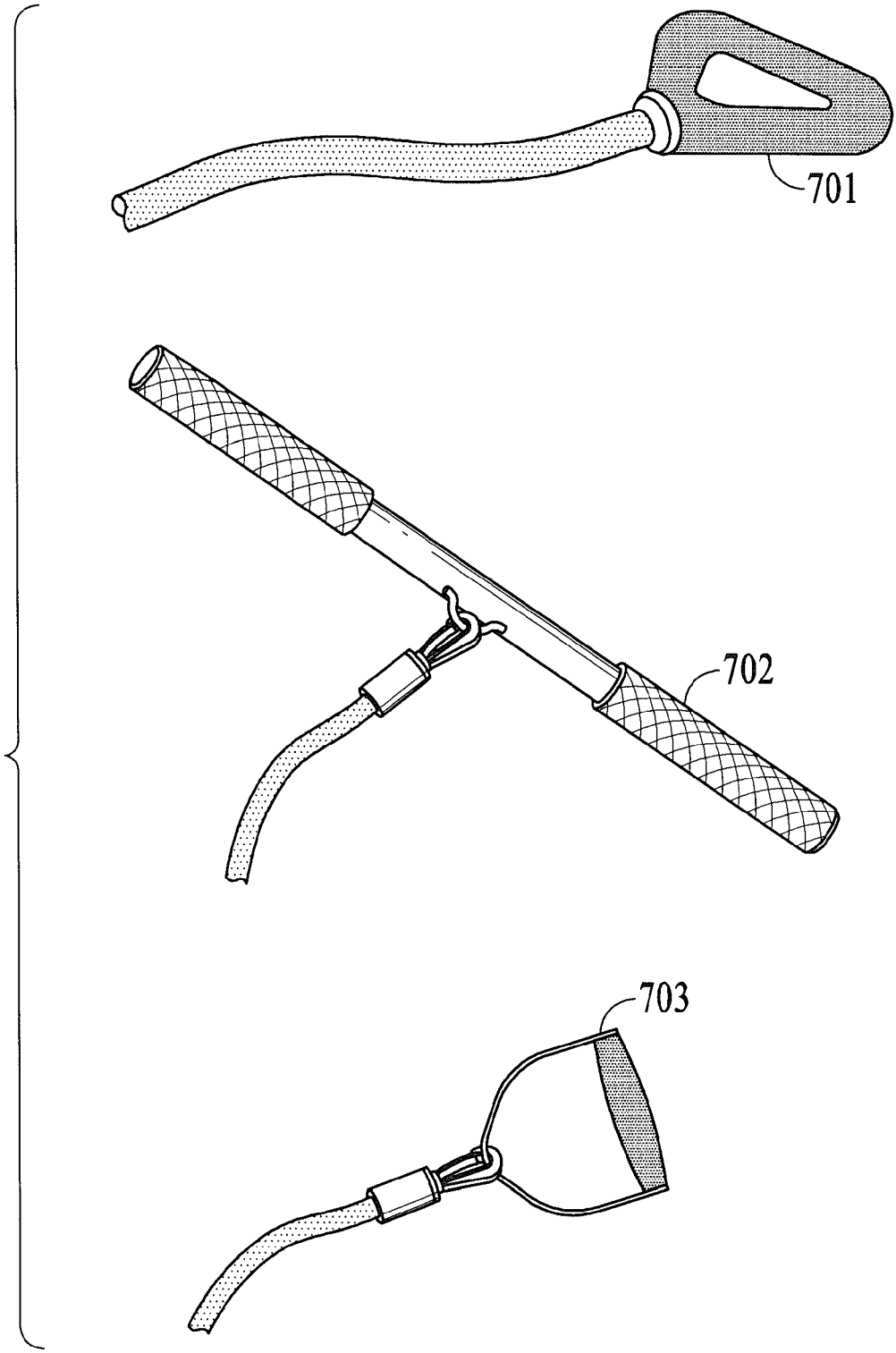
FIG. 7 illustrates various handle accessories that can be used in conjunction with an exercise sled, under an embodiment.

FIG. 6 illustrates a pulling cord that can be used with an exercise sled, under an embodiment. The cord 600 may include attachment rings 602 at one or both sides, and may be made of any appropriate material that is strong enough to accommodate the pulling weight of the sled. Examples of cords include bungee cords, rope, leather belts, nylon or canvas straps, and the like. The cord may include shoulder or waist pads or harnesses to increase comfort when used to pull the sled. Various handle accessories that can be used that can be used in conjunction with an exercise sled, under an embodiment. Such accessories are illustrated in FIG. 7 and include a single hand handle 701 formed as one of the cord, a pull bar 702 that can be used to facilitate gripping of the sled or attached cord by two hands, and a hand grip 703 that can be attached to the sled or cord through an attachment latch. In general, the pulling handles can be attached directly to the attachment hooks on the sled, or to a cord that is attached to the sled. FIG. 7 illustrates just a sample of different attachments or accessories that can be used in conjunction with the exercise sled. It should be noted that other accessories could also be used, such as pulleys, and so on.

Various different manufacturing methods and materials may be used to construct the exercise sled according to embodiments. In one embodiment, the upper and lower portions of the sled including the support posts are made using steel or iron tubes of square or rectangular cross-section, which are then welded to form the exercise sled portions. Tubes of different cross-sectional shapes may be used, and the construction method may utilize bolting, screwing, welding, gluing or similar means of attachment. Other materials may also be used to manufacture the sled, such as wood, carbon fiber, aluminum, or any other formable material.

The exercise sled can be used to perform virtually any number of exercises using just this one piece of equipment. It can be configured in a relatively easy manner by adding plate weights and pulling accessories. Various different workout regimens may be employed.

One example of an exercise sled workout regimen is as follows:

a. Warm-Up Exercises
stomach crunches on sled
knee raise crunches on sled
side crunches on sled
back extension on sled
abductors
adductors
prone or standing hi-knee runs with cords
prone fast leg curls with cords
step-ups (with or without cords)
box jumps (single or double leg)
sled pulls (with our without weights) with backward run or walk following pull
b. Upper Body Workout
shoulder shrugs
chest flys
bench press
double or single bent over rows
lateral arm raises
bent-over rear shoulder flys
front raises
high pulls
shoulder press
arm curls
wrist curls (forward and reverse)
tricep extensions
c. Lower Body Workout
squats
leg extension
leg curls
standing calf raises
single leg push backs The above listed exercise regimen is meant only to be illustrative of an example regimen, and many different exercises can be performed using the exercise sled.

The exercise sled represents a self-contained modular exercise unit that incorporates features that allow a person to perform a wide variety of exercises. The sled can be weighed down and pulled or pushed to perform power exercises. It can also be used as a stable platform for performing resistance exercises using cords and attachments. Finally, the upper portion can be used as a raised platform to perform aerobic exercises, such as jumping, step-ups and so on. The exercise sled represents an integrated piece of exercise equipment that allows a user to go from speed exercises to weight training exercises in a virtually non-stop manner using the same piece of equipment. The exercise sled can be used for lower body running, pulling, and jumping exercises immediately followed by upper body weight training exercises by pulling or lifting the sled. A number of people can use the exercise sled at one time using the multiple attachment points. The exercise sled represents a combination of a jumping box, which is raised platform box that can be stepped or jumped up onto, and a pulling sled, which is an object that can be attached to a person and towed while running or pulling. The exercise sled is adjustable with respect to height or angle on all four sides or corners of the box by disconnecting the retaining pins and raising or lowering the upper portion relative to the lower portion. Various different exercises may be performed by one or more people using the exercise sled. Such exercises can be used to increase running speed and running power through pulling/towing exercises or plyometric drills. Upper body strength can be increased by performing exercises with bands or cords that are attached to the fixed hooks positioned around the sled.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art.

The invention claimed is:

1. An exercise sled comprising:

a lower portion of substantially rectangular shape defined along a plane and having four legs positioned perpendicular to the plane at each corner of the rectangle, wherein the lower portion comprises a pair of rails for sliding across a ground each rail having a first portion with a surface engageable with the ground along the plane and an upwardly projecting portion rising up from the surface;

an upper portion detachably coupled to the lower portion through matching leg sections and including a flat surface, wherein the upper portion and lower portion each comprises a plurality of legs disposed perpendicular to the top surface, and wherein the legs of the upper portion are configured to be inserted within corresponding legs of the lower portion, and wherein the plurality of legs of the upper portion and lower portion each include at least one hole drilled therethrough to accommodate a fixing pin that fixes an inserted location of a leg of the upper portion to the corresponding leg of the lower portion; and a plurality of attachment hooks disposed around at least one of the lower portion and upper portion for facilitating pulling or pushing the sled across the surface.

2. The exercise sled of claim 1 wherein the lower portion includes a weight platform including a post structure to hold a weight plate.

3. The exercise sled of claim 2 wherein the weight platform comprises a flat section coupled between the pair of rails.

4. The exercise sled of claim 1 wherein the upwardly projecting portion comprises a curved portion, and the lower portion and upper portion include a frame structure.

5. The exercise sled of claim 4 wherein the frame structure comprises a metal tube structure.

6. The exercise sled of claim 5 wherein the tube structure includes a portion of square cross-section tubing.

7. The exercise sled of claim 1 further comprising a non-slip layer placed on top of the flat surface of the upper portion and configured to accommodate aerobic-style exercises.

8. The exercise sled of claim 7 wherein the non-slip layer is made of a material selected from the group consisting of: rubber, synthetic rubber, fabric, and mat.

9. The exercise sled of claim 7 wherein the aerobic-style exercises include running in place, step ups, sit ups, lunges, and squats.

10. The exercise sled of claim 1 wherein the plurality of attachment hooks are configured to attach to a plurality of cords.

11. The exercise sled of claim 10 further comprising a selection of accessories attachable to the cords to facilitate pushing or pulling the sled.

12. An apparatus for performing exercises by one or more people simultaneously by dragging the apparatus along a surface or using the apparatus as weight resistance, comprising:

a jumping box including an upper portion detachably coupled to a lower portion and a non-slip layer on a top surface of the box;

a sled portion formed as part of the jumping box and comprising upward projected rails configured to slide along the surface; and a plurality of fixed hooks disposed around the upper portion and lower portion to facilitate the attachment of pushing or pulling accessories, wherein the upper portion and lower portion each comprises a plurality of legs disposed perpendicular to the top surface, and wherein the legs of the upper portion are configured to be inserted within corresponding legs of the lower portion, and wherein the plurality of legs of the upper portion and lower portion each include at least one hole drilled therethrough to accommodate a fixing pin that fixes an inserted location of a leg of the upper portion to the corresponding leg of the lower portion.

13. The apparatus of claim 12 further comprising a weight platform coupled to the lower portion and configured to mount one or more weight plates to the apparatus.

14. The apparatus of claim 12 wherein the upper portion and lower portion are formed in a substantially square shape, and wherein the plurality of legs of the upper portion and lower portion each comprise four legs placed at the corners of the substantially square shape.

15. A modular exercise apparatus comprising:

a bottom sled portion comprising a pair of upward projecting rails having a flat section for sliding along a surface, wherein rails of the pair of rails are coupled to each other through a beam section;

an upper jumping box portion detachably coupled to the bottom sled portion through a telescoping leg assembly that allows the upper jumping box portion to be set at one of a plurality of defined heights relative to the surface; and a non-slip layer coupled the upper jumping box portion to facilitate movement of one or more users on the upper jumping box, wherein the telescoping leg assembly comprises a first set of legs coupled to the upper jumping box and disposed perpendicular to a plane defined by the surface; and a second set of legs coupled to the bottom sled portion and disposed perpendicular to the plane defined by the surface, and wherein the first set of legs is configured to be insertable into the second set of legs and attached in a fixed manner by pins inserted through holes formed in each of the first and second set of legs.

16. The apparatus of claim 15 further comprising a plurality of hooks disposed at fixed locations around the bottom sled portion and upper jumping box portion for attachment of pulling accessories, and further comprising a weight platform attached to the beam section for secure placement of weight plates to the apparatus.

* * * * *